US005560418A

United States Patent [19]

Kissinger

[11] Patent Number: 5,560,418

[45] Date of Patent: Oct. 1, 1996

[54] ATTACHMENT BAR FOR PARTITION PANEL

[75] Inventor: Terrance G. Kissinger, Belmont, Calif.

[73] Assignee: Advantage Office Systems, L.L.C., Mountain View, Calif.

[21] Appl. No.: 465,030

[22] Filed: Jun. 5, 1995

Related U.S. Application Data

[63] Continuation of Ser. No. 42,330, Apr. 2, 1993, abandoned.

[51] Int. Cl.[6] ..... A47G 5/00

[52] U.S. Cl. ..... 160/351; 248/243; 160/135

[58] Field of Search ..... 160/135, 351; 52/239, 36.5, 236.9, 243.1, 36.4; 211/187; 248/227, 241, 243

[56] References Cited

U.S. PATENT DOCUMENTS

| | | | |
|---|---|---|---|
| 3,134,567 | 8/1962 | Shoemaker | 248/243 |
| 3,700,385 | 10/1972 | Sherwood | 520/365 |
| 3,735,794 | 5/1973 | Lebowitz | 160/135 |
| 3,809,142 | 5/1974 | Bleeker | 160/135 |
| 3,987,836 | 10/1976 | LeMay | 160/135 |
| 4,047,342 | 9/1977 | Boulva | 52/239 |
| 4,070,803 | 1/1978 | Gartung | 52/36 |
| 4,104,838 | 8/1978 | Hage et al. | 52/239 |
| 4,120,124 | 10/1978 | Temple et al. | 52/122 |
| 4,159,775 | 7/1979 | Young, Jr. | 211/86 |
| 4,269,005 | 5/1981 | Timmons | 52/36 |
| 4,411,400 | 10/1983 | Everett | 248/216.1 |
| 4,508,300 | 4/1985 | Minick | 248/216.1 |
| 4,716,692 | 1/1988 | Harper et al. | 52/36 |
| 5,230,492 | 7/1993 | Zwart et al. | 248/222.1 |

*Primary Examiner*—David M. Purol

*Attorney, Agent, or Firm*—Skjerven, Morrill, MacPherson, Franklin & Friel; David E. Steuber

[57] ABSTRACT

An attachment bar is removably mounted on a partition panel at any position along the length of the panel. The attachment bar permits another panel, or a shelf or other accessory, to be mounted on the partition panel. This invention avoids the need to install a 3- or 4-way connection when adding an intersecting panel to a linear arrangement of partition panels.

2 Claims, 5 Drawing Sheets

ATTACHMENT BAR FOR PARTITION PANEL

This application is a continuation of application Ser. No. 08/042,330, field 04/02/93, now abandoned.

FIELD OF THE INVENTION

This invention relates to partition panels used in open office systems and, in particular, to an apparatus and technique for varying the configuration of an open office system.

BACKGROUND OF THE INVENTION

When open office systems first came into use several decades ago, one of their primary advantages was the ease with which they could be reconfigured to meet the needs of an office. Today, however, this flexibility has been seriously curtailed by the power and communications channels which are typically routed through the panels.

This problem can be illustrated by reference to FIG. 1, which shows a plan view of a cluster 10 of workstations 11A–11F. Cluster 10 includes a spine 12 from which a series of wing walls, illustrated by wing walls 13A and 13B, extend. The voice, data and power lines for the occupants of workstations 11A–11F typically run through a conduit which is located at the base of the panels which make up spine 12. These lines typically come from a ceiling connection which may be located, for example, at point 14.

The individual panels may vary in width from 1 foot to 5 feet and are either joined together directly, as at point 15, or with 2-way, 3-way or 4-way connectors (illustrated as 16A, 16B and 16C, respectively). A wall cannot be added at right angles to an existing wall without adding one of these connectors. For example, if it is desired to divide workstation 4F into two workstations, by adding a wall at point 15, a 3-way connector would be inserted at point 15.

To accomplish this, all of the communications and power lines which run through spine 12 must be disconnected. This has become a very expensive operation. The power and communications to all workstations 11A–11F must be disabled, and the occupants of these workstations are in effect put "out of business" until the lines are reconnected. Moreover, the occupants of workstations 11C and 11F would have to remove and pack up all work surfaces, shelves, etc., that are attached to spine 12 in order to permit the 3-way connector to be installed. Also, adding a connector increases the length of spine 12 by approximately 2 inches, and therefore reduces the width of an aisle adjacent to cluster 10.

The actual movement of the partition panels represents only a small portion of the total cost of adding a new wing wall. It has been estimated that 85–90% of the total cost goes into adjustments other than the physical addition of the wall.

At the end of each panel is a slotted "cantilever strip" which is used to attach shelves and other components to the partitions. The components are mounted on the cantilever strips by means of standardized mounting brackets having hooks which fit into the slots of the cantilever strip. At the present time, each shelf or other component must have a width which matches the width of the panel on which it is mounted. That is, a 2' wide shelf, for example, can be mounted only on a 2' panel. This seriously limits the flexibility of the office designer in using available components. It also increases the actual cost of the panels to the office owner. Larger panels are significantly less expensive on a linear foot basis; two 2' panels, for example, cost approximately 20% more than a single 4' panel. Thus, to the extent that smaller shelves and cabinets are required, the total cost of the panels increases. (As used herein, the term "component" includes shelves, cabinets, work surfaces, tack and white boards and any other item which may be attached to the side of a partition panel.)

Both of these problems are overcome with the attachment bar of this invention.

SUMMARY OF THE INVENTION

In accordance with this invention, a vertical attachment bar is fixed to the side of a partition panel, at a point where an intersecting panel or a shelf or other accessory is to be attached to the panel. A structure formed on or in the attachment bar mates with a corresponding structure on the partition, shelf or other component, thereby permitting the latter to be mounted on the bar.

Two illustrative embodiments are described. In a first embodiment, a pair of opposing attachment bars are tied together so as to form a loop which encloses the panel. In a second embodiment, the attachment bar is formed with a hook which engages an upper lip found on typical partition panels.

DESCRIPTION OF THE INVENTION

Figure 1:
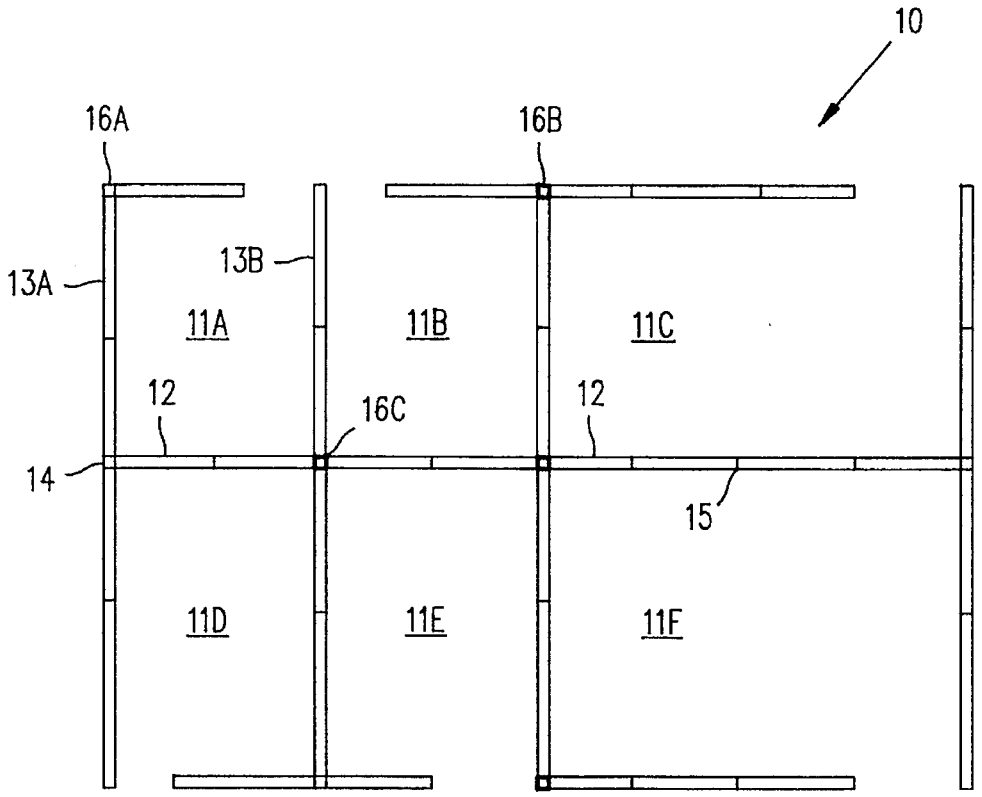
FIG. 1 illustrates a plan view of a conventional cluster of workstations formed with partition panels.
Figure 2:
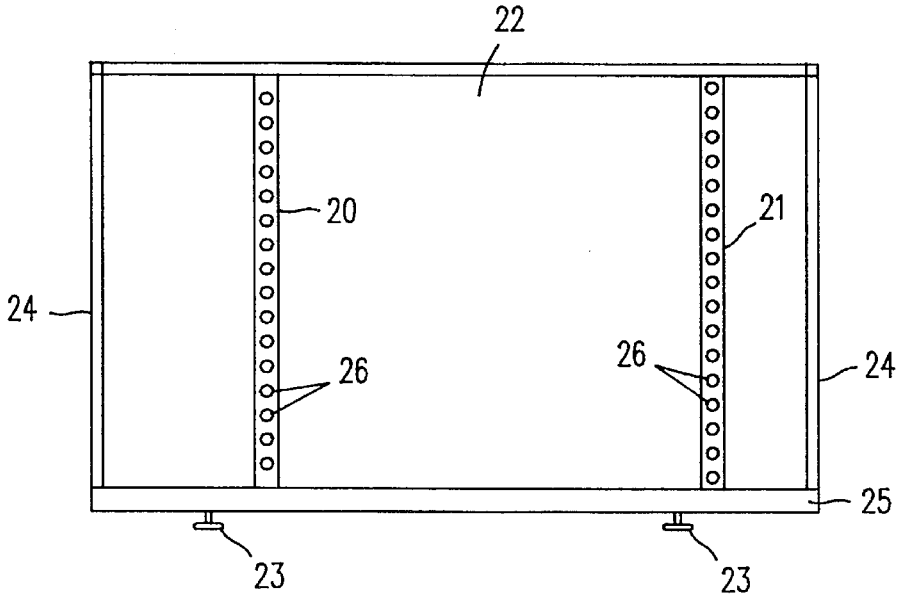
FIG. 2 illustrates a side elevational view of a partition panel having two attachment bars mounted on it.

FIG. 2 illustrates a general side elevational view showing attachment bars 20 and 21 in accordance with this invention, mounted on a partition panel 22. As is customary, panel 22 rests on feet 23, and standard cantilever strips 24 are positioned at the lateral edges of panel 22. Communications and power lines and cables may be routed through a conduit 25, which is attached at the bottom of panel 22. Each of bars 20 and 21 contains a series of holes 26 which are used, as described below, for mounting other panels and components to panel 22.

Figure 3:
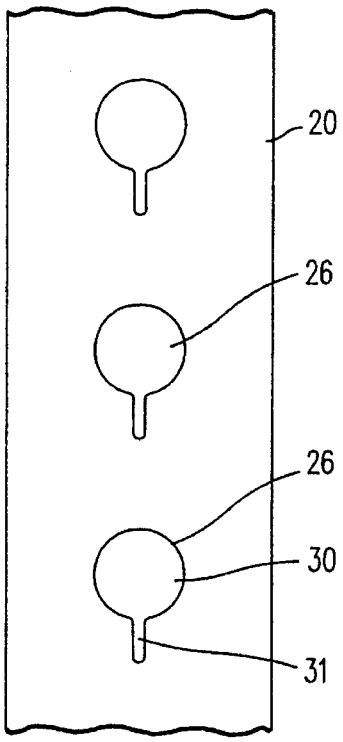
FIG. 3 illustrates a detailed elevational view of a portion of the attachment bar.
Figure 4A:
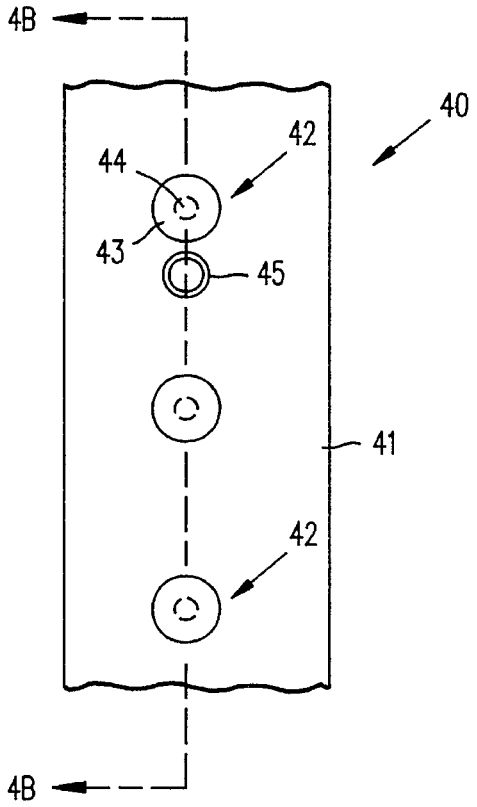
FIG. 4A illustrates a detailed elevational view of a portion of a mounting bracket.
Figure 4B:
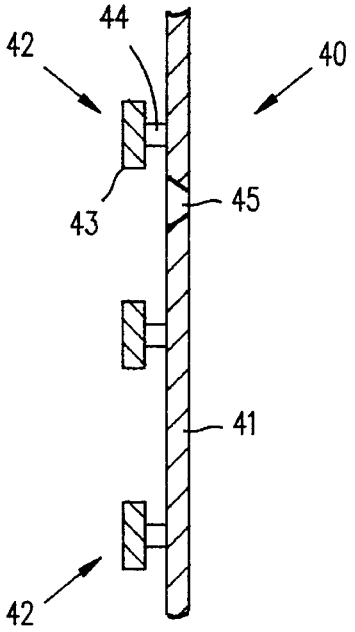
FIG. 4B illustrates a cross-sectional view of the mounting bracket.
Figure 5:
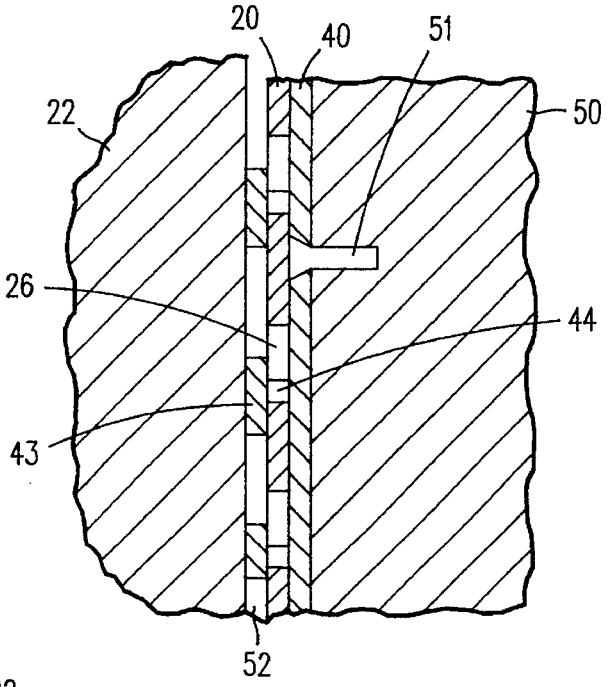
FIG. 5 illustrates detailed cross-sectional view of a partition or component: mounted on an attachment bar.

In the preferred embodiment, the other panels and components are mounted on panel 22 by means of the mechanism illustrated in FIGS. 3–5. FIG. 3 illustrates a detailed view of attachment bar 20 (attachment bar 21 is identical). As shown, each of holes 26 is keyhole-shaped and includes a large circular portion 30 and a relatively narrow neck portion 31. Attachment bar 20 is preferably formed of 14-gauge steel, and holes 26 are punched in the metal.

FIGS. 4A and 4B illustrate a mounting bracket which is attached to the panel, shelf or other component that is to be mounted onto panel 22. FIG. 4A is a side elevational view; FIG. 4B is a cross-sectional view taken at cross-section 4B—4B shown in FIG. 4A. Mounting bracket 40 includes a flat metal portion 41 to which are attached a series of mounting members 42. Each of mounting members 42 includes a flat disk 43 which is attached to metal member 41 by means of a stem 44.

The spacing between mounting members 42 is identical to the spacing between holes 26. The diameter of each disk 43 is slightly smaller than the diameter of the circular portion 30 of each hole 26. Thus, when mounting member 40 is brought face-to-face with bar 20, each of disks 43 fits through a corresponding circular portion 30, and as mounting member 40 is lowered with respect to bar 20 the stems 44 rest on the bottom edges of necks 31. In this position, mounting member 40 is securely fastened to attachment bar 20.

This position is illustrated in FIG. 5, which shows mounting member 40 attached to a panel or other component designated 50. As mentioned above, shelves and other components are typically mounted using mounting brackets with hooks which fit into the slots of a cantilever strip. In many situations, these mounting brackets may easily be removed from the shelf or other component, and a mounting member such as mounting member 40 may be substituted. In this embodiment, mounting member 40 contains a tapered screw hole 45 (see FIGS. 4A and 4B) and is mounted to element 50 by means of a countersunk screw 51. As FIG. 5 illustrates, the thickness of disks 43 pulls attachment bar 20 slightly away from the surface of panel 22, forming a gap identified as 5.2. Since attachment bar 20 is relatively flexible over lengths approximating the height of panel 22 (typically 62 inches), this does not create a problem. In fact, for panels which have sides made of a cushioned fabric, disks 43 will tend to become embedded in the soft cushion, and the gap will disappear.

Figure 6A:
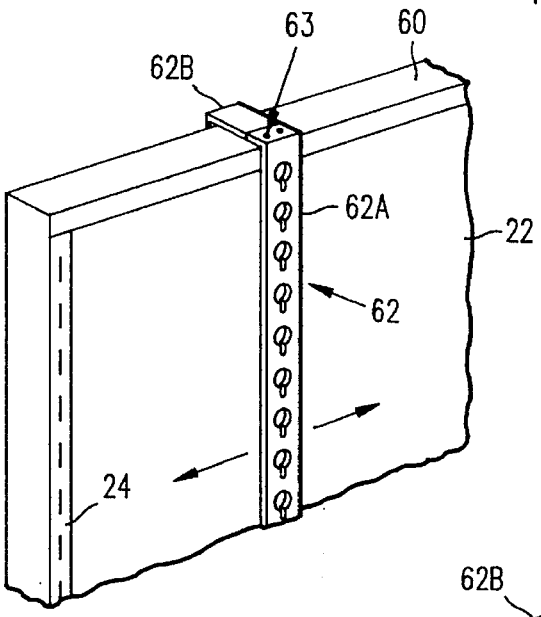
FIG. 6A illustrates a perspective view of a first embodiment of the attachment bar.
Figure 6B:
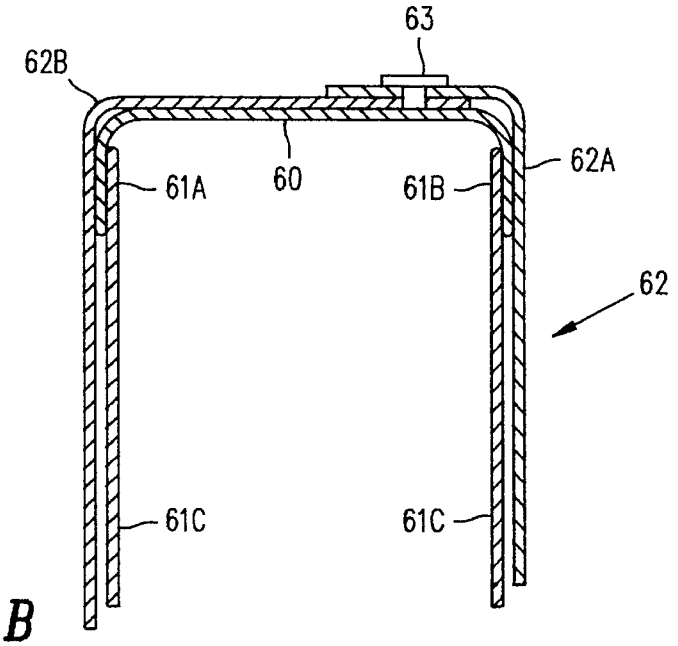
FIG. 6B illustrates a cross-sectional view of the first embodiment.

FIGS. 6 and 7 illustrate two techniques for mounting an attachment bar on panel 22. Referring first to FIGS. 6A and 6B, it is seen that panel 22 has a top cap 60, which is generally a U-shaped channel member which encloses the top of the panel. As is apparent from FIG. 6B, cap 60 fits over upper lips 61A and 61B, which are actually the top edges of the sheet metal sides 61C of the panel. Cap 60 is normally held in place with a spring (not shown).

Attachment bar 62 includes two portions, 62A and 62B, which are overlapped at the top of panel 22 and fastened together with two flat-head screws 63. (FIG. 6B is a cross-sectional view taken through one of screws 63.) Portions 62A and 62B of attachment bar 62 are fastened together in a similar manner at the bottom of panel 22. Thus, attachment bar 62 is in reality a loop which surrounds panel 22. Attachment bar 62 may be slid laterally in either direction on panel 22, although it may be necessary to loosen screws 63 in order to do this. In any event, when screws 63 are fastened, attachment bar 62 rests securely on panel 22 and forms a stable base for mounting other panels or components in the manner described above.

Figure 7A:
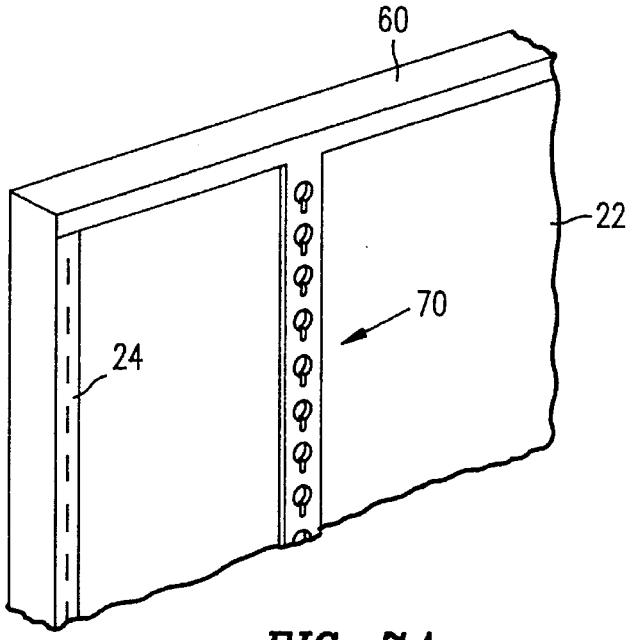
FIG. 7A illustrates a perspective view of a second embodiment of the attachment bar.
Figure 7B:
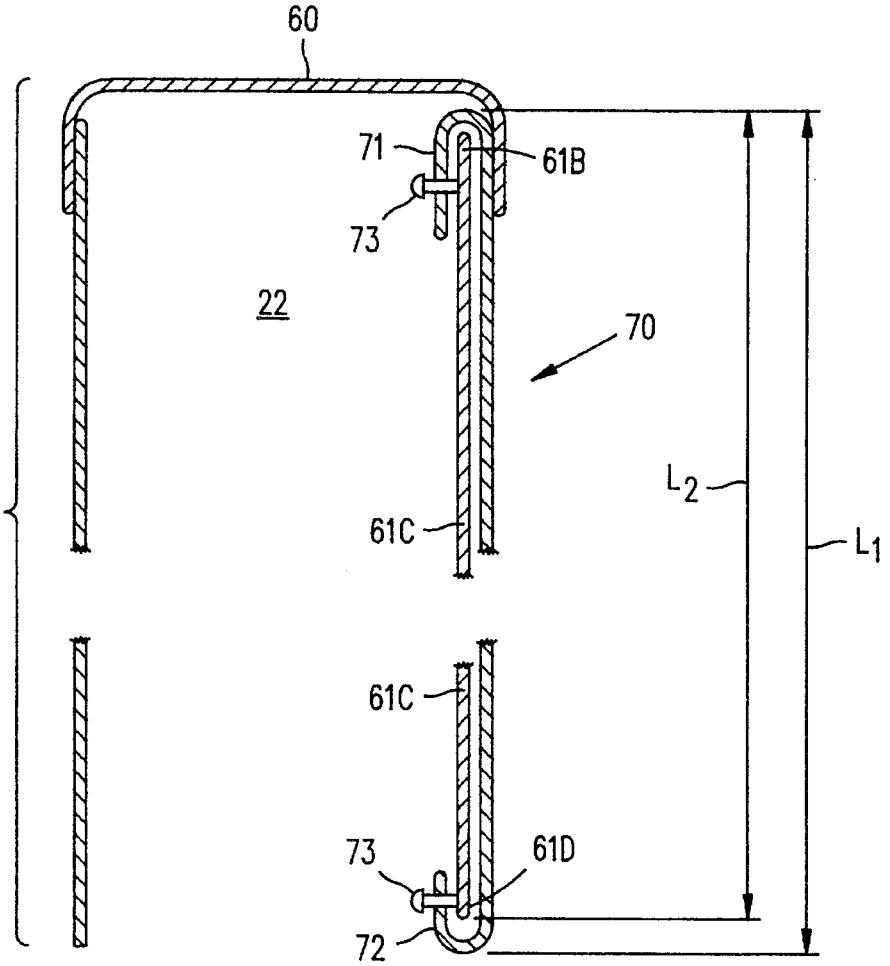
FIG. 7B illustrates a cross-sectional view of the second embodiment.

FIGS. 7A and 7B illustrate a second embodiment showing an attachment bar 70. As shown in FIG. 7B, a hook 71 is formed at the top of attachment bar 70. Hook 71 fits over upper lip 61B, securely fastening attachment bar 70 to panel 22. A similar hook 72 is formed at the bottom of attachment bar 70, and the total length $L_1$ of attachment bar 70 is made slightly greater than the vertical dimension $L_2$ between upper lip 61B and a lower lip 61D, over which hook 72 fits. Since attachment bar 70 is relatively flexible, hooks 71 and 72 can be made to fit over upper lip 61B and lower lip 61D, respectively. Set screws 73 fasten bar 70 securely to upper lip 61B and lower lip 61D. Similarly, cap 60 is also flexible and easily fits over attachment bar 70 at the top of panel 22. To move attachment bar 70 laterally, cap 60 is removed, and bar 70 is slid along panel 22. This embodiment, as compared to the first embodiment shown in FIGS. 6A and 6B, has the advantage that there need not be a corresponding attachment bar on the opposite side of panel 22. Each side of the panel may be configured separately. As is apparent, attachment bar 70 is supported only at points of contact with panel 22 which are located in regions near the respective ends of attachment bar 70. There are no supporting contact points in the central region of attachment bar 70. When set screws 73 are loosened, bar 70 may be slid laterally in either direction on panel 22.

Figure 8:
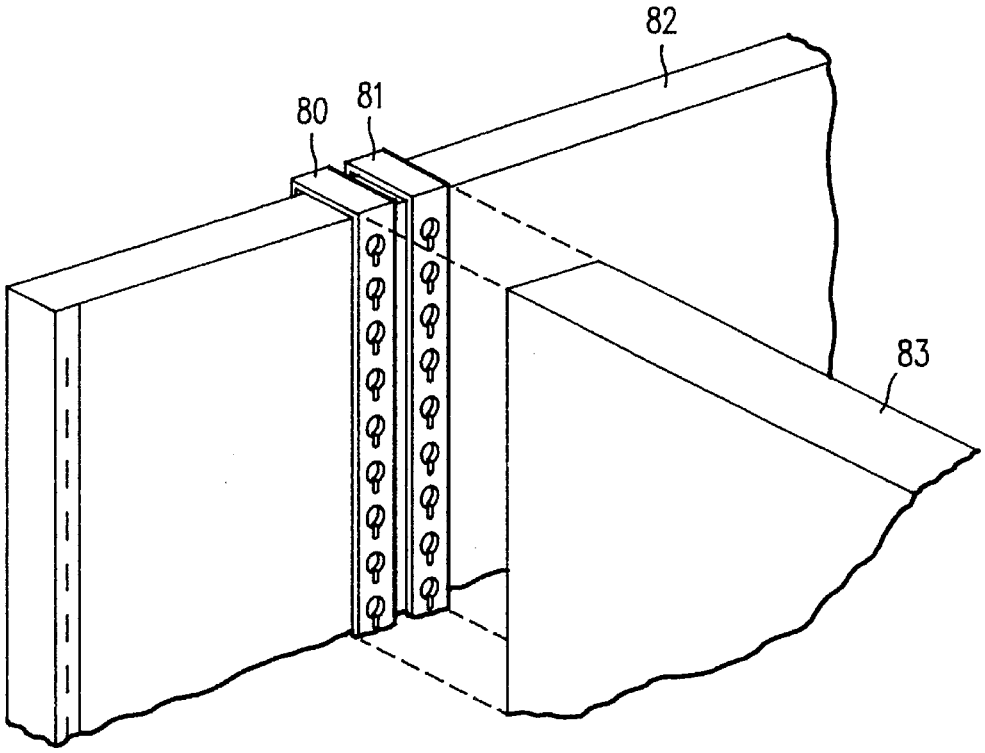
FIG. 8 illustrates a perspective view of a partition panel mounted on a side-by-side pair of attachment bars.

For mounting intersecting panels, it may be desirable to position two attachment bars side-by-side in order to provide more stability to the structure. Such an arrangement is shown in FIG. 8, where paired attachment bars 80 and 81 are positioned side-by-side on a panel 82 and used to mount on intersecting panel 83. Alternatively, a single, wider attachment bar may be formed, with two rows of holes.

Figure 9:
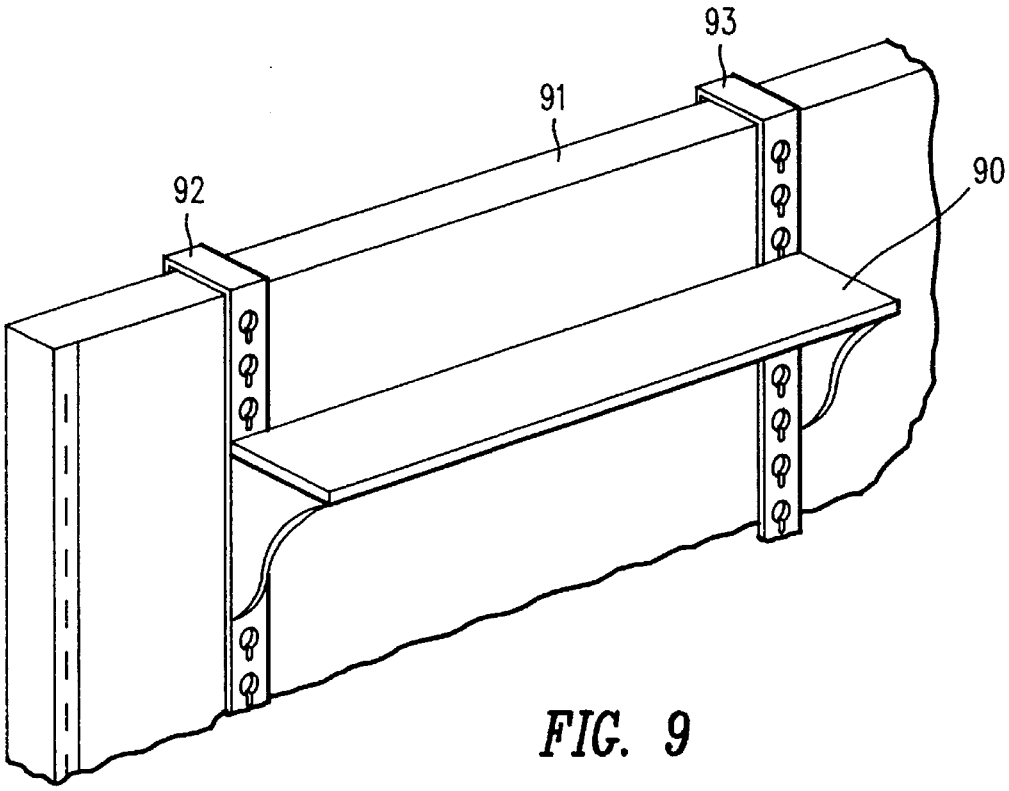
FIG. 9 illustrates a perspective view of a shelf mounted on a pair of attachment bars.

FIG. 9 illustrates a shelf 90 mounted on a panel 91 by means of two attachment bars 92 and 93. It is clear that the width of shelf 90 (or of a cabinet or any other component) need not coincide with the width of panel 91.

It will be apparent to those skilled in the art that there are many ways of .attaching a panel or other component to the attachment bar of this invention. Various types of hooks may be used, for example. Similarly, there are many ways of fixing the attachment bar to the panel. While this invention has been described with reference to open office systems, it is applicable to a partition panels used in any location, including factories, stores and homes. All such alternatives are to be considered as being within the broad scope of this invention, as defined in the following claims.

I claim:

1. An attachment system in combination with a partition panel having a top edge, a bottom edge, lateral edges, and opposing first and second side walls;

said attachment system comprising first and second longitudinal members, said first longitudinal member lying flat against said first side wall and having a first portion thereof disposed above said top edge of said partition panel and a second portion thereof extending beneath said bottom edge of said partition panel, said second longitudinal member lying flat against said second side wall and having a first portion thereof disposed above said top edge of said partition panel and a second portion thereof extending beneath said bottom edge of said partition panel, said first portion of said first longitudinal member being connected to said first portion of said second longitudinal member and said second portion of said first longitudinal member being connected to said second portion of said second longitudinal member such that said first and second longitudinal members form a loop enclosing said partition panel;

a first fastener for connecting said first portion of said first longitudinal member to said first portion of said second longitudinal member;

a second fastener for connecting said second portion of said first longitudinal member to said second portion of said second longitudinal member;

said first longitudinal member having a means for mounting a component thereto;

said attachment system being movably fixed between the lateral edges of said partition panel so as to be selectively movable thereon.

2. The attachment system of claim 1 wherein each of said means for mounting comprises a series of slotted openings.

* * * * *